US005749747A

United States Patent [19]

Inaba et al.

[11] Patent Number: 5,749,747

[45] Date of Patent: May 12, 1998

[54] PARTIAL-FITTING PREVENTION CONNECTOR

[75] Inventors: Shigemitsu Inaba; Makoto Yamanashi; Yukio Ohta; Masaru Fukuda; Eiji Fukuda, all of Shizuoka, Japan

[73] Assignee: Yazaki Corporation, Tokyo, Japan

[21] Appl. No.: 773,573

[22] Filed: Dec. 27, 1996

[30] Foreign Application Priority Data

Dec. 28, 1995 [JP] Japan ..... 7-343456

[51] Int. Cl.[6] ..... H01R 13/627

[52] U.S. Cl. ..... 439/358; 439/352

[58] Field of Search ..... 439/350–358, 439/345

[56] References Cited

U.S. PATENT DOCUMENTS 5,350,312 9/1994 Kuno et al. ..... 439/352
5,362,248 11/1994 Hashiguchi et al. ..... 439/352
5,376,014 12/1994 Sumida ..... 439/352
5,380,217 1/1995 Yagi et al. ..... 439/350

*Primary Examiner*—Hien Vu
*Attorney, Agent, or Firm*—Sughrue, Mion, Zinn, Macpeak & Seas, PLLC

[57] ABSTRACT

A partial-fitting prevention connector which can be positively fitted relative to a mating connector, and is prevented from being only partially fitted relative to the mating connector. When the partial-fitting prevention connector (1) is fitted relative to a mating connector (2), a retaining member (25), formed on a lock member (22), abuts against a retaining projection (34) formed on the mating connector (2), and the lock member (22) is pushed against the bias of a spring (23) in a rearward direction away from the mating connector. After the lock member has moved a predetermined distance, lock release projections (26*a* and 26*b*), formed on the lock member (22), slide over lock release projections (42*a* and 42*b*) formed on a support structure (41), thereby pivotally moving the lock member (22). When the fitting operation is further continued, the lock member (22) is urged by the spring (23) in the forward direction toward the mating connector and engages the retaining projection (34) to thereby retain the connectors to each other.

12 Claims, 10 Drawing Sheets

PARTIAL-FITTING PREVENTION CONNECTOR

DETAILED DESCRIPTION OF THE INVENTION

1. Field of the Invention

This invention relates to a partial-fitting prevention connector, for example, for electrically connecting wires to respective mating wires in a waterproof manner, and more particularly to a partial-fitting prevention connector which can be easily fitted relative to a mating connector, and is positively prevented from being partially fitted relative to the mating connector.

2. Related Art

Many electronic devices for various controls are mounted on current automobiles, and naturally many wire harnesses and flat cables are used. Automobiles are used in severe environments in which the automobile is subjected to vibration and moisture. Therefore, in view of an assembling process and the maintenance, partial-fitting prevention connectors with a waterproof function have been used to easily connect and disconnect wires such as wire harnesses.

One conventional connector will now be described with reference to FIGS. 10 and 11. A pin-type connector 50 has a plurality of pin contacts 52 arranged therein, and has a pair of mounting flanges 50*a* formed respectively at opposite sides thereof. A socket-type connector 51 has a plurality of socket contacts 53 arranged therein, and wires 53*a* are connected to the socket contacts 53, respectively.

The pin-type connector 50 includes a box-shaped housing 54 having an open front side, and a guide plate 55, for guiding the fitting of the socket-type connector 51, mounted centrally of the height within the housing 54, and dividing the interior of the housing 54 into an upper portion and a lower portion. As shown in FIG. 11, within the housing 54, the pin contacts 52 extend from a rear portion toward the front side of this housing. A notch is formed in a central portion of a top plate 54*b*, and a forwardly-directed engagement piece portion 56 is formed integrally with the top plate 54*b*, and is disposed in this notch. A distal end of the engagement piece portion 56 terminates short of the front edge of the top plate 54*b*, and can be slightly flexed outwardly. An inwardly-directed engagement projection 56*a* is formed on the distal end of the engagement piece portion 56.

The socket-type connector 51 includes a box-shaped housing 57, and has such a size as to be fitted into the opening in the housing 54 of the pin-type connector 50. Pin holes 58 for respectively receiving the pin contacts 52, and a slot 59 for receiving the guide plate 55 are provided in the front side of the housing 57.

A movable cover 60 is movably fitted on the housing 57, and covers the housing 57 except front and rear end portions thereof. An opening 61 for receiving the pin-type connector 50 is formed in the front side of the movable cover 60. The opening 61 is sized to receive opposite side plates 54*a*, the top plate 54*b* and a bottom plate 54*c* of the housing 54, but the distal end of the engagement piece portion 56 can abut against the edge of the opening 61, thereby preventing the housing 54 from being inserted into the opening 61.

A pair of spring receiving portions (not shown) are formed respectively at opposite side portions of the movable cover 60 and hence at opposite side portions of the housing 57, and springs 64 are received respectively in the spring receiving portions as indicated in broken lines in FIG. 10, each of the springs 64 extending in the forward-backward direction. The movable cover 60 is normally urged forward (that is, left in FIG. 10) by the springs 64, and is retained by slots 65, formed through an upper wall of the movable cover 60, and projections 66 formed on the upper surface of the housing 57. An engagement groove 67 is formed in the upper surface of the housing 57, and the engagement projection 56*a* is engaged in the engagement groove 67 when the two connectors are completely connected together. The engagement groove 67 is normally concealed by the movable cover 60, and appears when the movable cover 60 is moved.

When the two connectors are fitted together, the pin contacts 52 contact the socket contacts 53, respectively, and the engagement projection 56*a* is engaged in the engagement groove 67, as shown in FIG. 11. In this fitted condition, the springs 64 are compressed, and the engagement piece portion 56 is covered by the movable cover 60, so that the engagement projection 56*a* can not be disengaged from the engagement groove 67, thereby positively maintaining the connected condition.

On the other hand, when the completely-fitted condition is not achieved, that is, a partial-fitted condition is encountered, the distal end of the engagement piece portion 56 abuts against the edge of the opening in the movable cover 60, and the springs 64 are compressed. Therefore, the movable cover 60 presses the engagement piece portion 56 under the influence of the springs 64, and therefore the two connectors 50 and 51 are urged away from each other, and can not be fitted together at all.

In the above connector, the partial-fitting can be prevented. However, when the two connectors are to be fitted together while holding the opposite side surfaces of the movable cover 60 with the user's hand, the movable cover 60 fails to be moved, so that the fitting operation can not be achieved. Further, the engagement piece portion 56 is not covered by the housing 57, and therefore when an external force acts on the movable cover 60, the movable cover 60 can be easily moved, so that the fitted condition of the connectors can be accidentally released.

SUMMARY OF THE INVENTION

It is an object of this invention to provide a partial-fitting prevention connector which can be positively fitted relative to a mating connector, and is prevented from being partially fitted relative to the mating connector.

The above object of the present invention has been achieved by a partial-fitting prevention connector described as follows.

A partial-fitting prevention connector wherein a connector and a mating connector are fitted and connected together, one of the two connectors is of the female type whereas the other connector is of the male type, and wherein, due to a bias of a resilient member mounted within a housing, a retaining member can be retainingly engaged with a retaining projection formed on the mating connector, thereby preventing a partial-fitted condition. The connector is characterized in that a connection portion, including a terminal receiving chamber and a connection terminal, is provided within the housing; and there is provided retaining means which comprises a lock member and a support structure; the lock member is pushed when the connector is fitted relative to the mating connector, and is pivotally moved in accordance with an amount of the pushing movement, and is returned under the bias of the resilient member, and is retainingly engaged with the retaining projection formed at one end of the mating connector; and the support structure supports the lock member in such a manner that the lock member is automatically pushed, pivotally moved and returned.

The retaining means includes: a retaining member which abuts against the retaining projection, formed on the mating connector, to push the lock member, and which is retainingly engaged with the retaining projection when the lock member is returned; a lock release projection which causes the lock member to pivotally move when the lock member has moved a predetermined distance; a support projection supporting the lock member for pivotal movement; and the resilient member which is fixed at one end to one end of the housing, and urges the lock member so as to return the lock member.

The support structure comprises: a guide portion formed on a side surface of the housing for guiding a first lock release projection formed on the lock member; a second lock release projection which acts on the first lock release projection to pivotally move the lock member when the lock member is moved a predetermined distance; and another guide portion which allows the lock member to pivotally move about a support projection, and guides the movement of the lock member.

The connection portion includes a waterproof packing against which one end of an insertion frame of the mating connector is pressed when the mating connector is fitted in the connector, thereby preventing the intrusion of water, and the connection portion also includes a rubber plug which prevents the intrusion of water along a wire.

An opening is formed in that portion of the housing disposed near to the lock member, and the housing and the opening are covered with a cover, and a fitting-release door, which can be opened and closed, is formed in that portion of the cover disposed in registry with the opening, and when releasing the fitting of the mating connector in the connector, the fitting-release door is opened, and the lock member is pressed, thereby releasing the retaining engagement of the lock member with the retaining projection.

When the above partial-fitting prevention connector is fitted relative to the mating connector, the retaining member, formed on the lock member, abuts against the retaining projection formed on the mating connector, and the lock member is pushed against the bias of the spring, and the lock release projections, formed on the lock member, slide respectively over the lock release projections formed on the support structure, thereby pivotally moving the whole of the lock member. When the fitting operation is further continued, the lock member is urged by the resilient member, and is caused to move beyond the retaining projection, and is retained there, thereby effecting the complete fitting of the connector on the mating connector.

Therefore, if the fitting operation is stopped halfway, the lock member is not pivotally moved, and the lock member is urged by the resilient member, and therefore the connector is urged by the resilient member, and is disconnected from the mating connector, and the partially-fitted condition can be positively recognized.

DETAILED DESCRIPTION OF THE INVENTION

Figure 1:
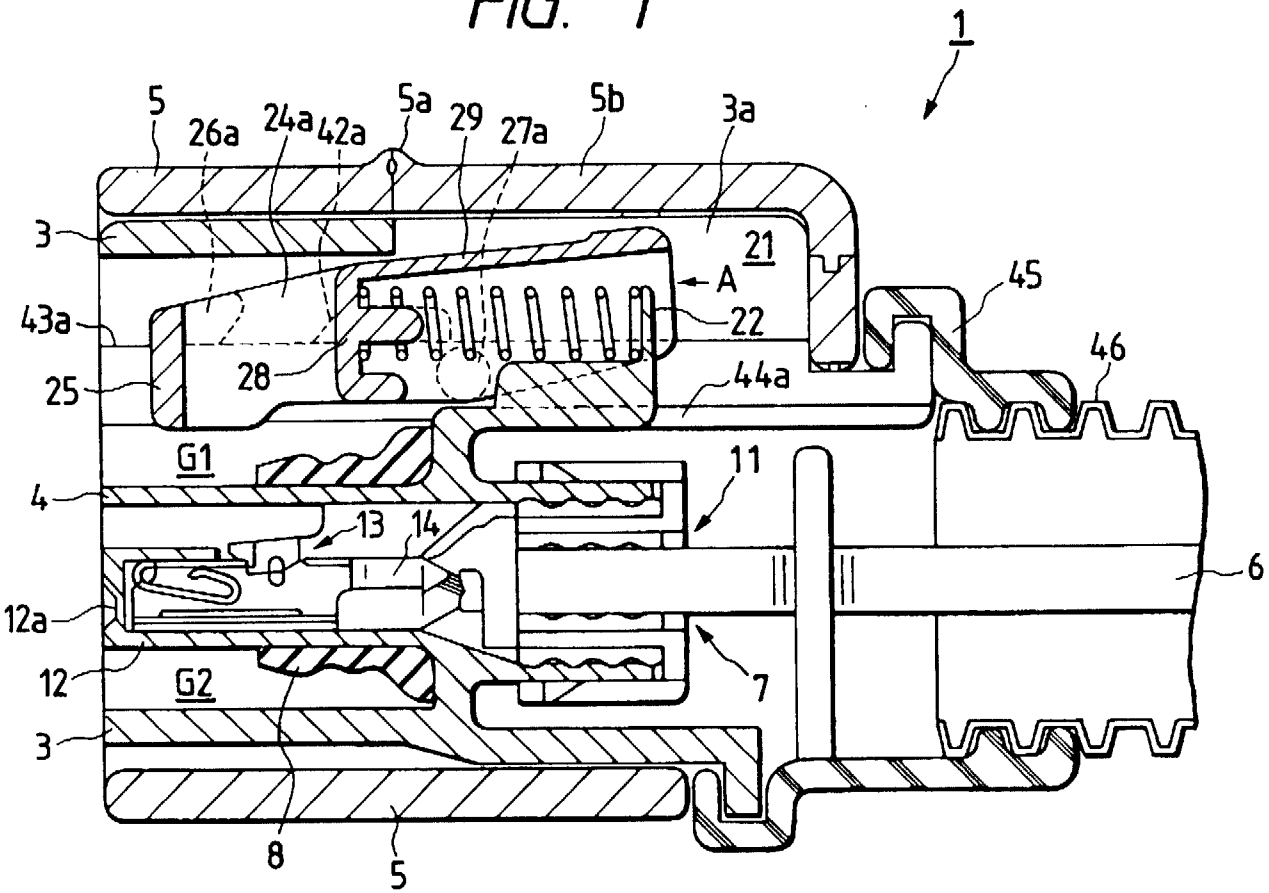
FIG. 1 is a vertical cross-sectional view of an embodiment of a partial-fitting prevention connector of the present invention.
Figure 2:
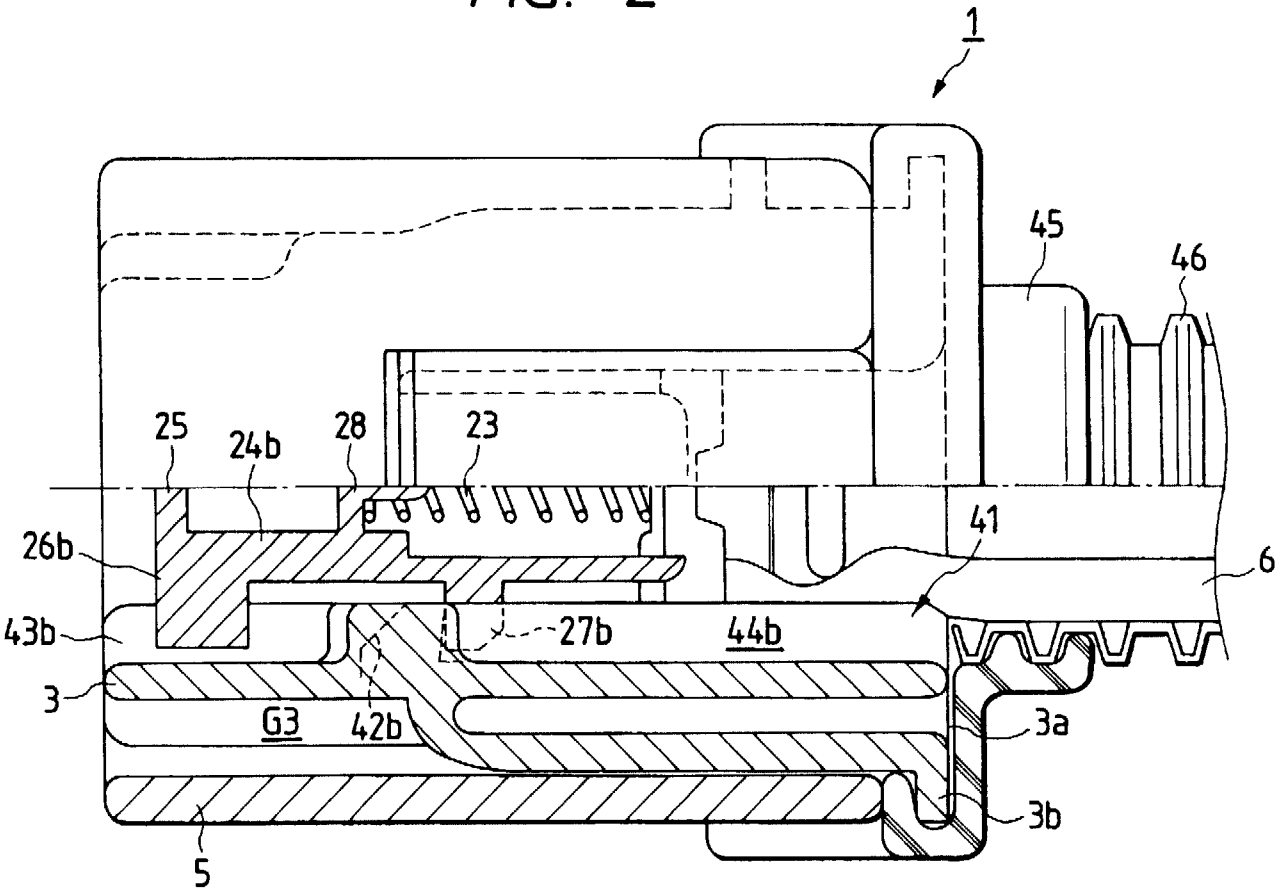
FIG. 2 is a partly-broken, plan view showing the construction of the partial-fitting prevention connector.
Figure 4:
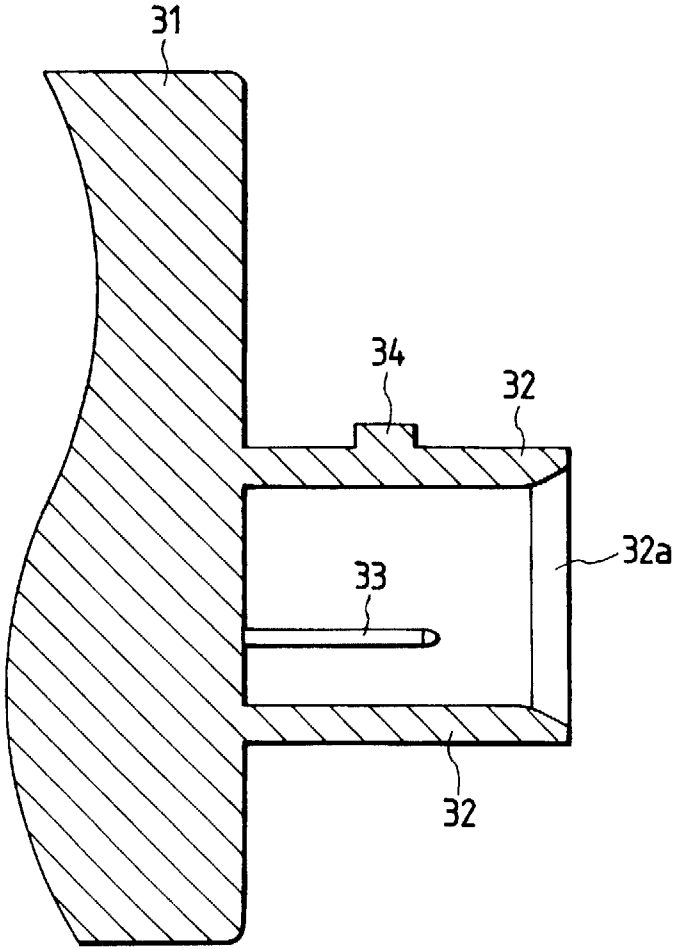
FIG. 4 is a cross-sectional view of an important portion of a mating connector.
Figure 3:
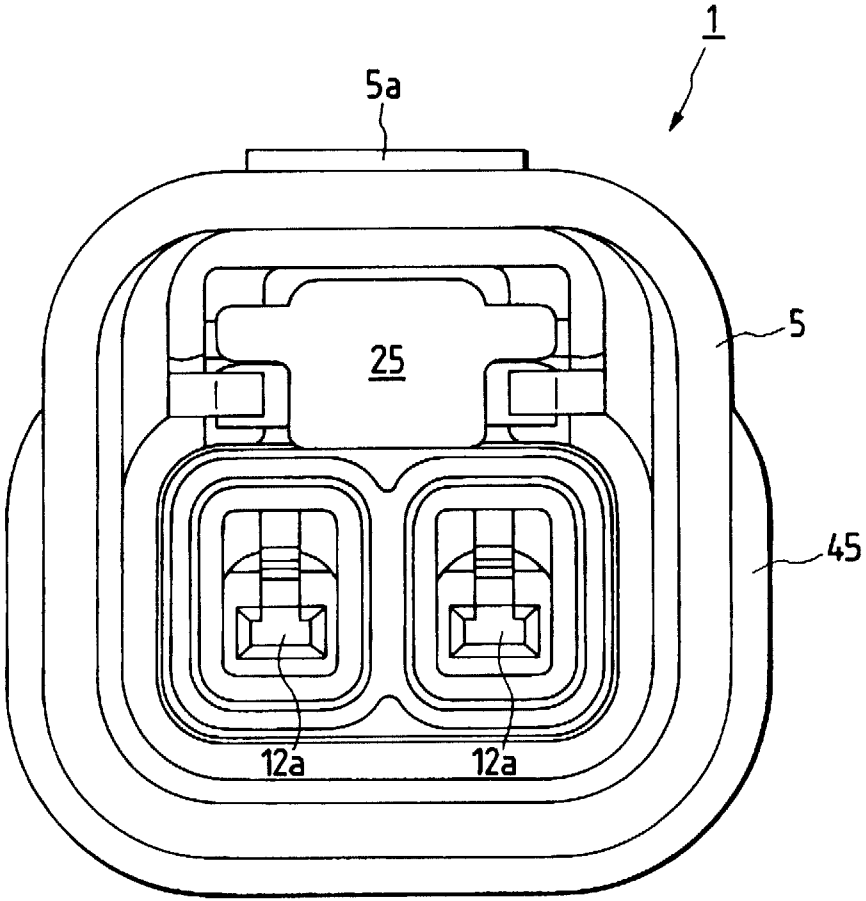
FIG. 3 is a front-elevational view showing the construction of the partial-fitting prevention connector.

A preferred embodiment of a partial-fitting prevention connector (hereinafter referred to merely as "connector") of the present invention will now be described with reference to FIGS. 1 to 9. FIG. 1 is a vertical cross-sectional view showing the construction of the connector, FIG. 2 is a partly-broken, plan view showing the construction of the connector, FIG. 3 is a front-elevational view showing the construction of the connector, FIG. 4 is an enlarged, cross-sectional view of an important portion of a male connector, FIGS. 5 to 8 are vertical cross-sectional views showing the operation of the connector, and FIG. 9 is a vertical cross-sectional view showing the release of the fitting of the connector.

The construction of the connector will first be described, followed by the fitting of the connector relative to a mating connection, and the release of the fitting of the connector.

The connector 1 is of the female type, and is of such a construction that the connector 1 is prevented from being partially fitted (or incompletely fitted) relative to the mating connector 2 of the male type. With respect to the basic construction of the connector 1, the connector 1 includes a housing 3 of an integral construction molded of a synthetic resin, and retaining means 21 provided within the housing 3. The retaining means 21 retains the mating connector 2 when the mating connector 2 is connected to a connection portion 11, and the retaining means 21 has a partial-fitting prevention function.

The connection portion 11 is provided in a waterproof manner below a partition wall 4 separating the interior of the housing 3 into an upper portion and a lower portion, and the retaining means 21 is provided on the upper side of the partition wall 4. A cover 5 is mounted on the outer periphery of the housing 3, and part of the cover 5 defines a fitting-release door 5*b* which can be opened and closed through a hinge 5*a*.

The connection portion 11 includes two terminal receiving chambers 13 formed below the partition wall 4 by a separation wall 12, and connection terminals 14 mounted respectively in the terminal receiving chambers 13 against withdrawal therefrom. The connection terminal 14 is retained on one end of the separation wall 12 against withdrawal, and one end of the connection terminal 14 communicates with an insertion hole 12*a* through which a connection terminal 33 of the mating connector 2 is inserted, and a wire 6 is connected to the other end of the connection terminal 14.

A rubber plug 7 for waterproof purposes is fitted on the wire 6, and prevents the intrusion of water along the surface of the wire 6. A waterproof packing 8 is also fitted on proximal end portions of the partition wall 4 and the separation wall 12, and when the connector 1 is fitted in the mating connector 2, the waterproof packing 8 is pressed against one end of a housing, that is, one end of an insertion frame 32, thereby preventing the intrusion of water.

The retaining means 21 comprises a lock member 22 which is pivotally movable about an axis disposed at one end portion of the housing 3, and is movable along the length of the housing 3 (that is, in the longitudinal direction), and a spring 23 normally urging the lock member 22 in a direction indicated by arrow A. The retaining means 21 cooperates with a retaining projection 34, formed on one end portion of the insertion frame 32 of the mating connector 2, to achieve the retaining function and the partial-fitting prevention function.

The constituent members of the retaining means 21 will now be described. The lock member 22 includes a plate-like retaining member 25 which has an open top and an open bottom, and is supported by support members 24*a* and 24*b* at their opposite sides, lock release projections 26*a* and 26*b* formed respectively on opposite sides of the retaining member 25, support projections 27*a* and 27*b* which are formed respectively on outer surfaces of the support members 24*a* and 24*b*, and allow the whole of the lock member 22 to pivotally move and to move in the longitudinal direction, a plate-like spring retainer portion 28 which is provided generally centrally of the lock member 22, and is formed integrally with the support members 24*a* and 24*b*, and the spring 23 which is held against one end of the partition wall 4, and urges the whole of the lock member 22 in the direction of arrow A.

The upper side of the lock member 22 is inclined upwardly from left to right (that is, from the front end (facing the mating connector 2) toward the rear end), and the lower side of the lock member 22 is inclined upwardly from the support projections 27*a* and 27*b* toward the rear end.

Therefore, the entire lock member 22 can be pivotally moved about the support projections 27*a* and 27*b*. The upper side of the rear end portion of the lock member 22 is closed whereas the lower side is open for assembling purposes. This closed portion defines a press portion 29 which is pressed by the finger or other to pivotally move the lock member 22 in a clockwise direction (FIG. 1) so as to release the retaining engagement with the mating connector 2.

Next, a support structure 41 of the lock member 22 will be described. The support structure 41 is provided using the opposed inner side surfaces of the housing 3. More specifically, as shown in FIG. 2, that portion of each of the opposite side walls of the housing 3, extending from its central portion to its rear end, has a double-wall construction defined by walls 3*a* and 3*b*. Lock release projections 42*a* and 42*b* are formed respectively on the inner surfaces of the opposed inner walls 3*a*, and project toward the centerline of the housing 3. Shelf-like guide portions 43*a* and 43*b* extend from the lock release projections 42*a* and 42*b* toward the front end of the housing 3, and guide portions 44*a* and 44*b* extend from the lock release projections 42*a* and 42*b* toward the rear end of the housing 3.

FIG. 1 is a vertical cross-sectional view of the connector 1, and therefore in FIG. 1, the left guide portions 43*a* and 44*a* as viewed from the front side are indicated by lines, and FIG. 2 shows the right structure of the connector 1 in a plan view, and therefore in FIG. 2, the right guide portions 43*b* and 44*b* as viewed from the front side are illustrated.

As shown in FIG. 2, gaps G3 are formed between the housing 3 and the cover 5, and part of the insertion frame 32 of the mating connector 2 is inserted into gaps G3 when the mating connector 2 is fitted in the connector 1.

Next, the construction of the mating connector 2 will be described. The insertion frame 32 for fitting into the connector 1 projects from a base plate 31, and the connection terminals 33 are provided within the insertion frame 32 against withdrawal. A retaining projection 34 for retaining the retaining member 25 is formed on an upper surface of the insertion frame 32 disposed above the connection terminals 31.

When the connector 1 and the mating connector 2 are fitted together, upper and lower walls of the insertion frame 32 are inserted respectively into gaps G1 and G2 (where the waterproof packing 8 is present) in the connector 1, with the separation wall 12 received in the insertion frame 32, as shown in FIGS. 6 to 9. Therefore, a tapered surface 32*a* is formed on the inner surface of the distal end of the insertion frame 32, so that the separation wall 12 can be easily inserted into the insertion frame 32.

Figure 5:
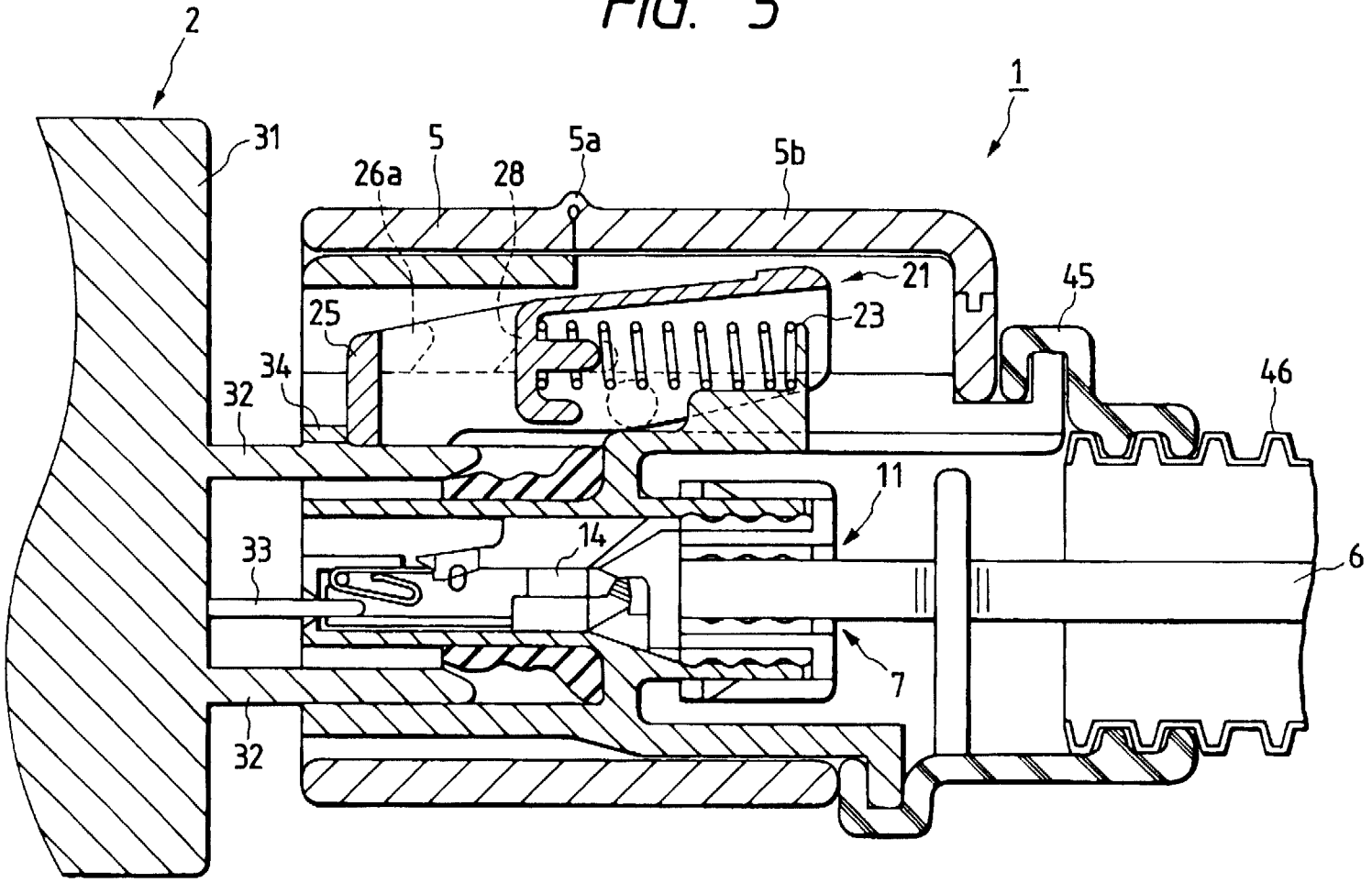
FIG. 5 is a vertical cross-sectional view showing an initial condition during the fitting of the partial-fitting prevention connector.

The fitting of the connector 1 into the mating connector 2 will now be described with reference to FIGS. 5 to 8. When fitting the connector 1 and the mating connector 2 together, the insertion frame 32 is inserted into the gaps G1 and G2 in the connector 1 as shown in FIG. 5, and then is further pushed thereinto. The vertical walls of the insertion frame 32 shown in FIG. 4 are inserted respectively into the gaps G3 shown in FIG. 2.

When the connector 1 is continued to be pushed in this condition, the retaining projection 34, formed on the mating connector 2, abuts against the retaining member 25 formed at the distal end of the lock member 22, so that the connector 1 is once stopped as shown in FIG. 5.

Figure 6:
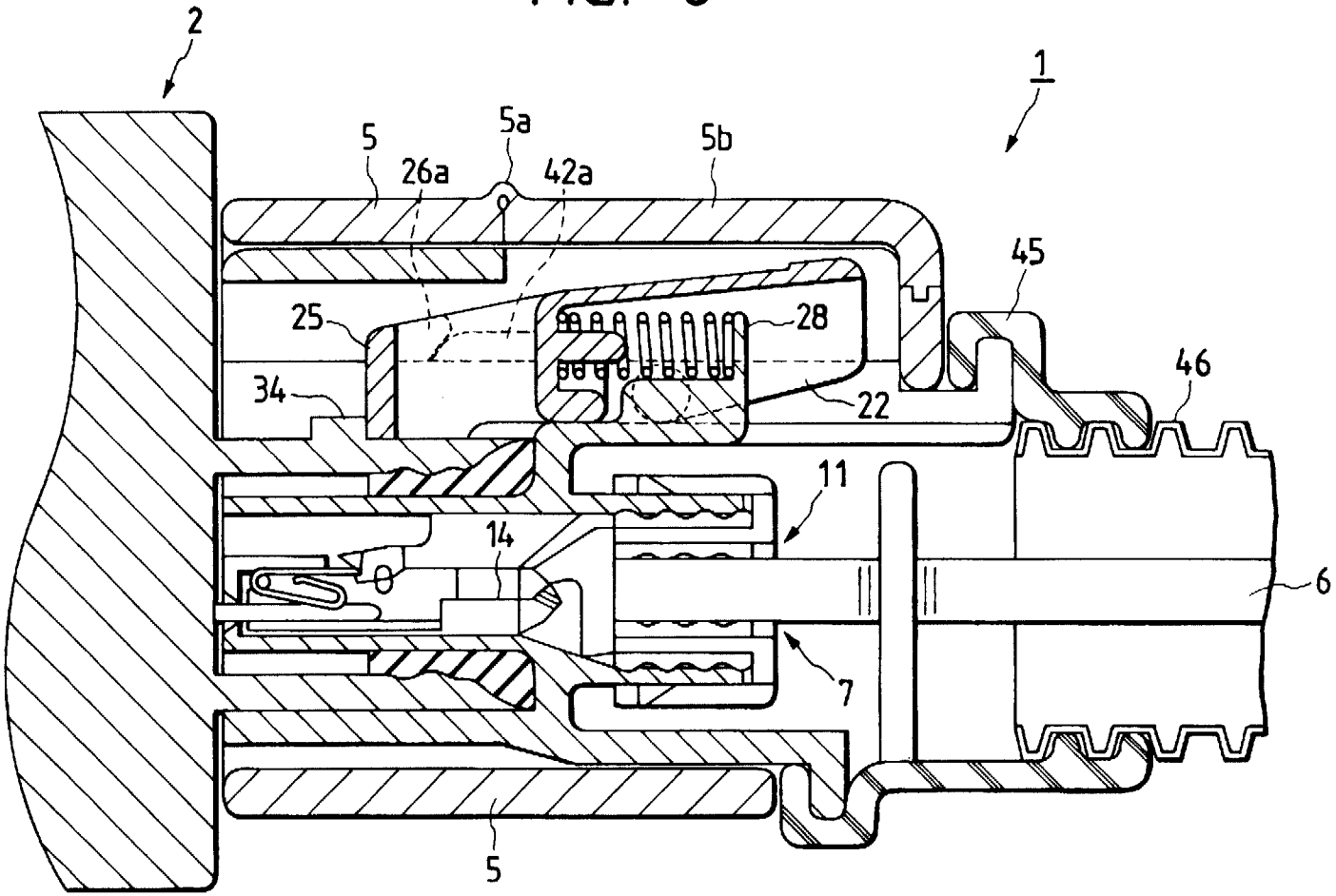
FIG. 6 is a vertical cross-sectional view showing the pushing of a lock member during the connector-fitting operation.

However, when the connector 1 is further pushed in this condition, the entire lock member 22 is moved rearwardly toward the rear end of the connector 1 against the bias of the spring 23. Then, the front end of the housing 3 becomes close to the base plate 31 of the mating connector 2 as shown in FIG. 6. However, at this time, the retaining member 25 is not retained by the retaining projection 34, and therefore if the pushing of the connector 1 is stopped, the connector 1 will move away from the mating connector 2 under the influence of the spring 23.

Also, in this condition, downwardly-facing slanting surfaces, formed respectively on the lock release projections 26*a* and 26*b* formed on the lock member 22, are abutted respectively against upwardly-facing slanting surfaces formed respectively on the lock release projections 42*a* and 42*b* formed on the housing 3, as shown in FIG. 6.

Figure 7:
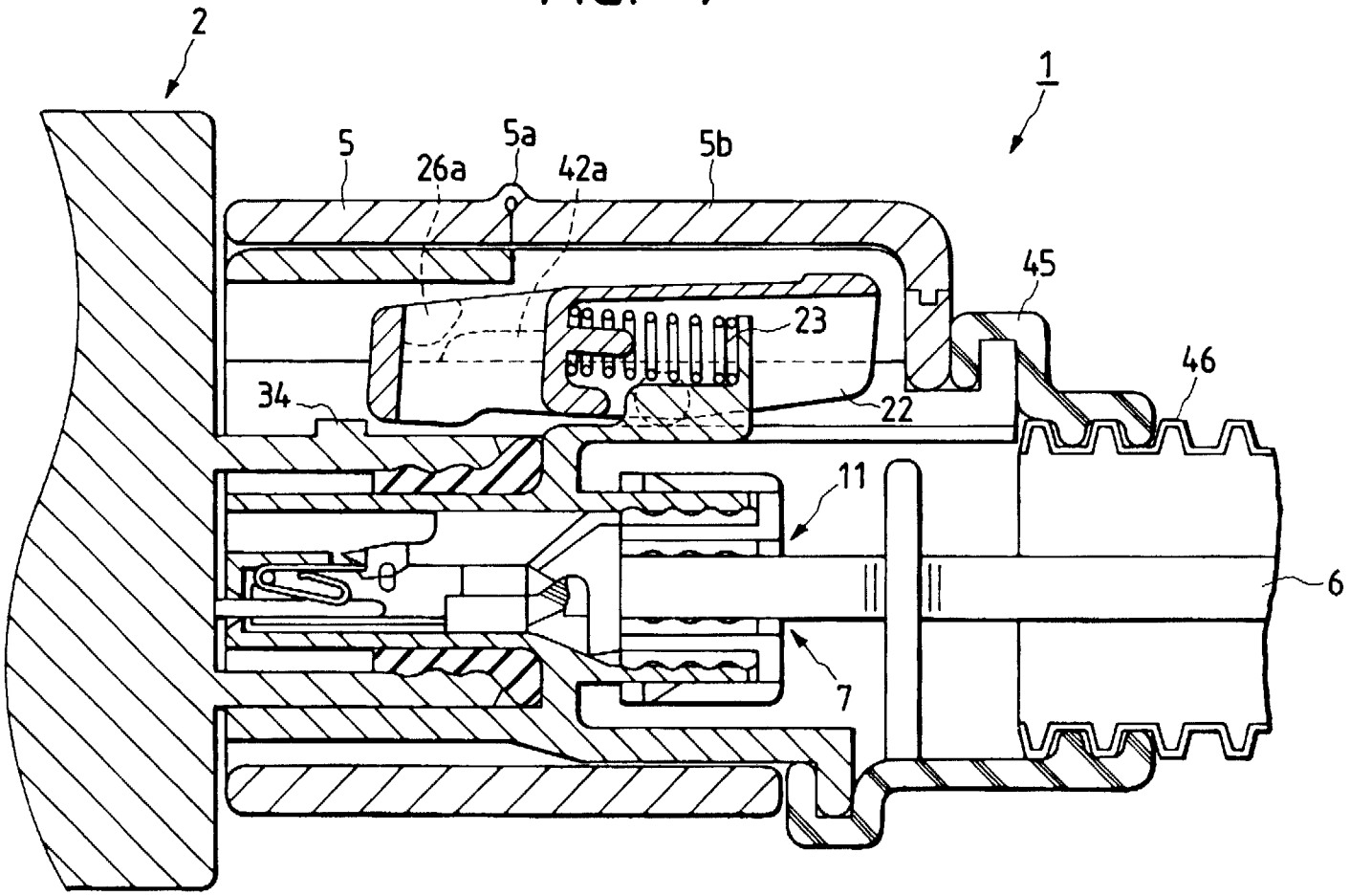
FIG. 7 is a vertical cross-sectional view showing the pivotal movement of the lock member during the connector-fitting operation.

In this condition, when the connector 1 is further pushed, the lock member 22 is further moved toward the rear end of the connector 1, and therefore the lock release projections 26*a* and 26*b*, formed on the lock member 22, slide respectively over the lock release projections 42*a* and 42*b* formed on the housing 3, as shown in FIG. 7.

Namely, the front end of the lock member 22 is forcibly lifted, and the lock member 22 is pivotally moved clockwise about the support projections 27*a* and 27*b* as shown in FIG. 7. As a result, the retaining member 25 is disengaged from the retaining projection 34, and the spring 23, held against one end of the partition wall 4 (that is, one end of the housing 3), urges the lock member 22 in the direction of arrow A.

Figure 8:
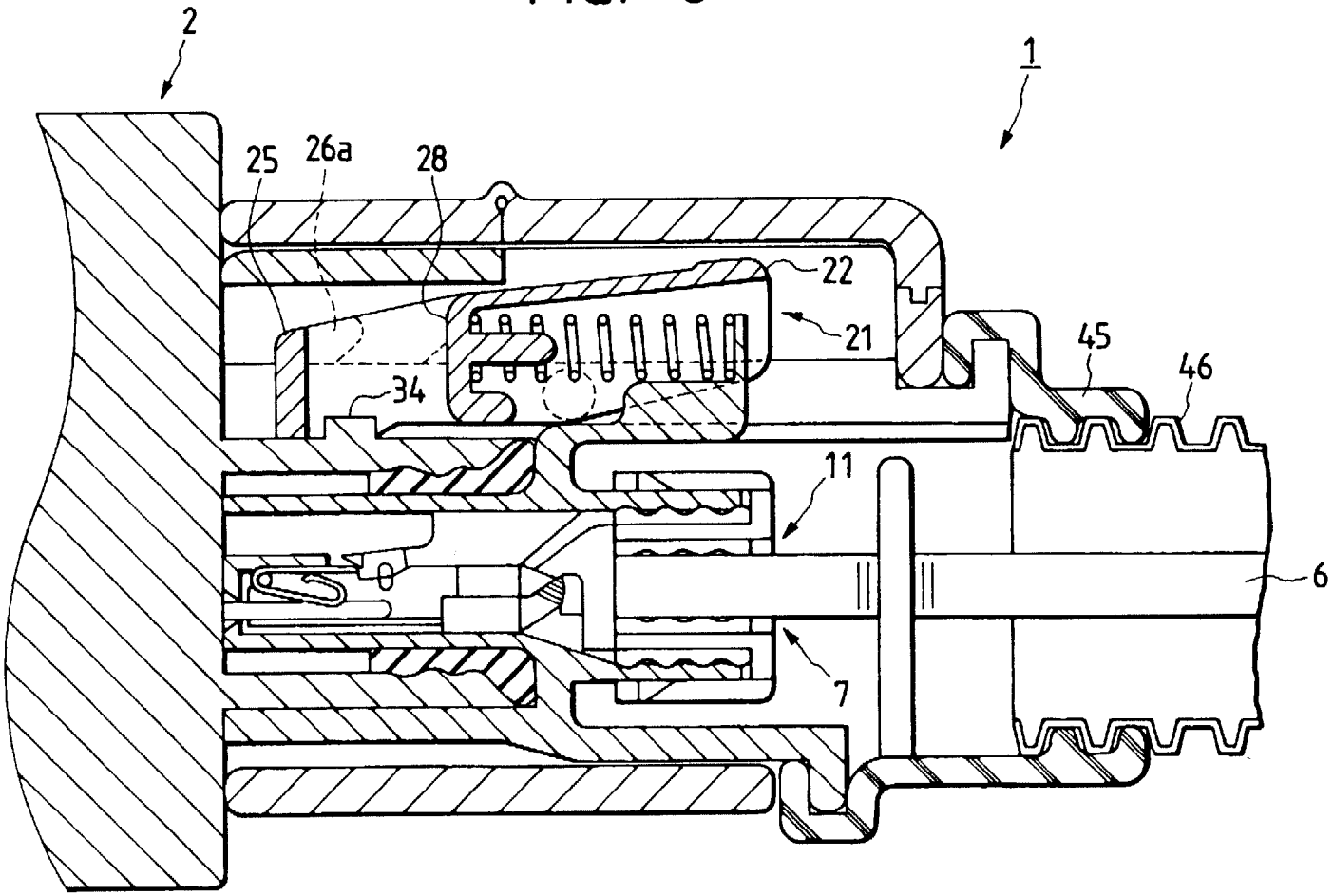
FIG. 8 is a vertical cross-sectional view showing the returning movement of the lock member during the connector-fitting operation.
Figure 9:
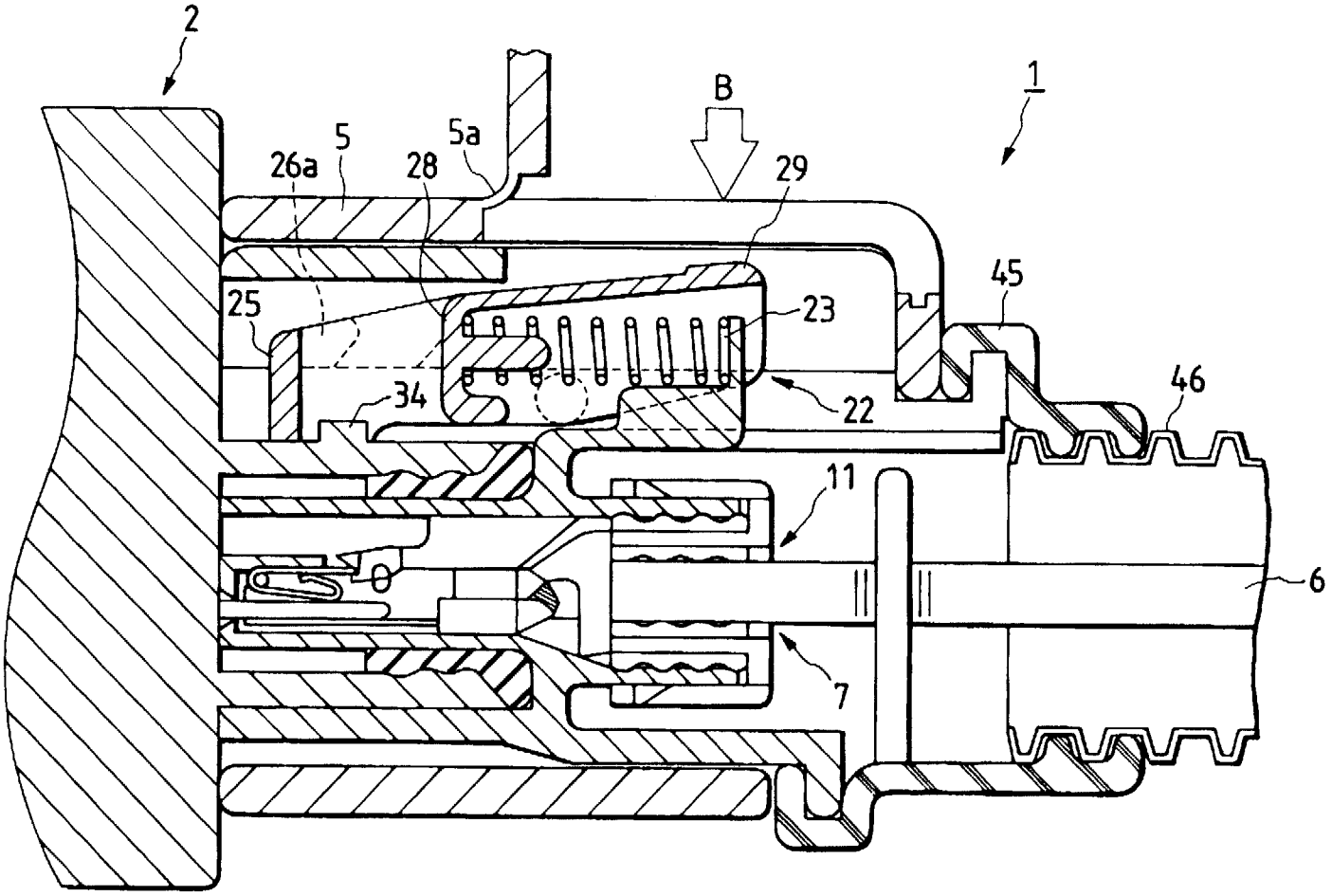
FIG. 9 is a vertical cross-sectional view showing the movement of the lock member when releasing the fitting of the connector.
Figure 10:
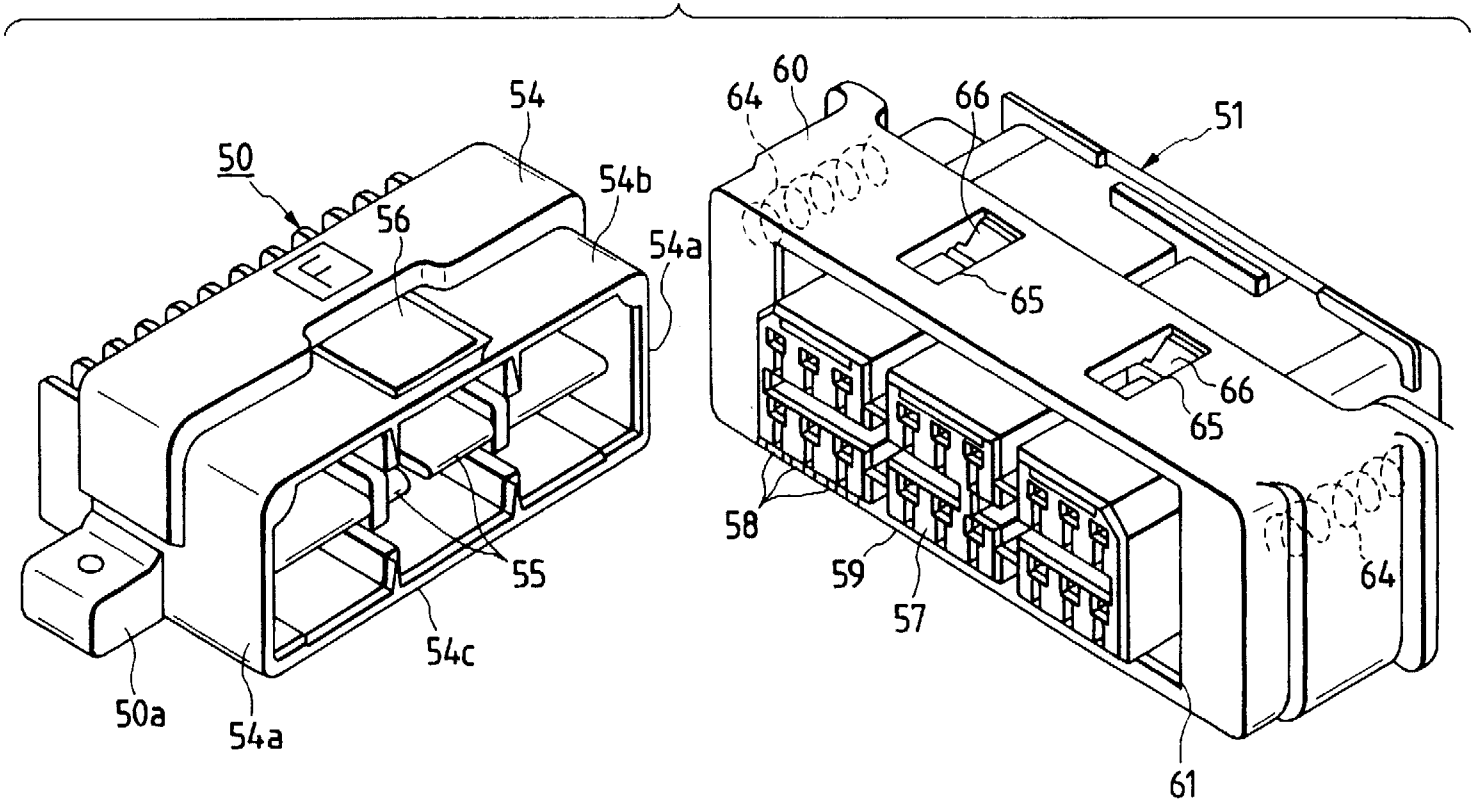
FIG. 10 is a perspective view of a conventional connector.
Figure 11:
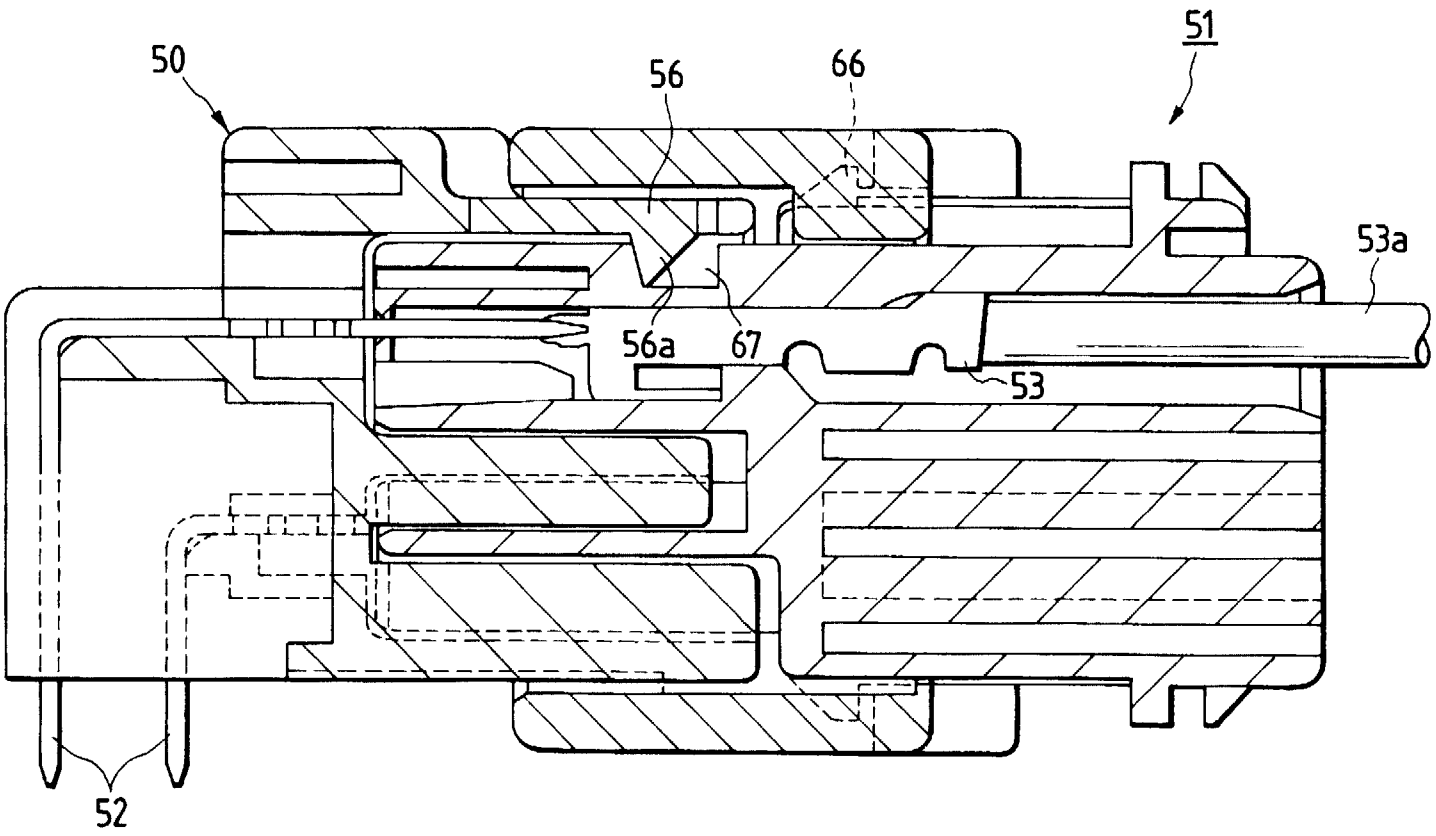
FIG. 11 is a vertical cross-sectional view showing the fitting of the conventional connector.

When the lock member 22 is thus urged in the direction of arrow A, the retaining member 25 moves over the retaining projection 34, and at the same time the lock member 22 is pivotally moved in a counterclockwise direction, so that the retaining member 25 is brought into contact with the upper surface of the insertion frame 32 of the mating connector 2, as shown in FIG. 8. Namely, the retaining projection 34 is disposed inwardly of the retaining member 25, and even if the connector 1 is pulled away from the mating connector 2, the retaining member 25 is retained by the retaining projection 34, thereby preventing the disengagement of the connector 1 from the mating connector 2.

Namely, when the connector 1 of this embodiment is partially fitted relative to the mating connector 2, the lock member 22 can not be pivotally moved, and in such a partially-fitted condition the connector 1 is automatically pushed away from the mating connector 2 under the influence of the spring 23. Therefore, there is no possibility that the partially-fitted condition (that is, the incompletely-fitted condition) of the connector 1 relative to the mating connector 2 will be mistaken for the completely-fitted condition.

Next, the release of the fitting will be described. The fitting-release door **5*b* is opened, and the press portion 29 is pressed by the finger or other in a direction of arrow B as shown in FIG. 9. As a result, the lock member 22 is forcibly moved pivotally clockwise about the support projections 27*a* and 27*b*, and the retaining member 25 rises higher than the retaining projection 34, thus releasing the retained condition, so that the connector 1 can be disengaged from the mating connector 2**.

The rear end of the housing 3, through which the wires 6 are extended, is covered with a rear cover 45, and the rear cover 45 retains a corrugated tube 46 enclosing the wires 6.

In the connector 1, it is important to note that merely by pushing the connector 1, the lock member 22 is pushed back, and is pivotally moved, and is further moved forward in the direction of arrow A under the influence of the spring 23, and is further retainingly engaged with the mating connector 2, and these operations are effected automatically. If a partially-fitted condition is encountered, the automatic retaining operation is interrupted halfway, and the connector 1 is moved away from the mating connector 2, from which the partially-fitted condition can be confirmed. If the fitting position is not proper, the fitting operation can be carried out, and therefore the wrong fitting will not be effected.

Further, the retaining means 21 is covered with the cover 5, so that the press portion 29 is not accessible by the finger if the fitting-release door 5 is not opened, and therefore the fitted condition will not be released accidentally or inadvertently. Therefore, the connector 1 is positively maintained in the fitted condition relative to the mating connector 2, and also the partial-fitting prevention is positively achieved. An accident, such as the disconnection of the connector in use, can be prevented, and therefore the reliability of a device or an electronic equipment, for example, of an automobile using the connector 1, can be greatly enhanced, and other effects such as easy maintenance are achieved.

Furthermore, the construction is simple, and the number of the component parts is smaller, and the assembling operation is easy, and thus the connector of the invention have various advantages over the conventional connector of this type.

As described above, when the partial-fitting prevention connector of the present invention is fitted relative to the mating connector, the retaining member, formed on the lock member, abuts against the retaining projection formed on the mating connector, and the whole of the lock member is pushed against the bias of the resilient member, and the lock release projections, formed on the lock member, slide respectively over the lock release projections formed on the support structure, thereby pivotally moving the whole of the lock member, and when the fitting operation is further continued, the lock member is urged by the resilient member, and is caused to move beyond the retaining projection, and is stopped there, thereby automatically effecting the fitting of the connector relative to the mating connector. If the fitted condition is incomplete, the lock member is not pivotally moved, and the connector is pushed back away from the mating connector, and therefore an incompletely-fitted condition (that is, a partially-fitted condition) can be positively prevented.

Therefore, the fitting of the connector relative to the mating connector can be automatically effected positively, and if the partially-fitted condition is encountered, the connector is automatically pushed back, and therefore there is no possibility that the partially-fitted condition is mistaken for the completely-fitted condition. And besides, for releasing the fitting, the lock member must be pressed by the finger or other, and the lock member is covered with the cover, and therefore the fitted condition will not be accidentally released, and because of these effects, the reliability of a device or equipment, for example, of an automobile using the connector of the invention can be greatly enhanced.

We claim:

1. A partial-fitting prevention connector, comprising:

a first connector having a plurality of terminal accommodating chambers extending in a longitudinal direction for receiving first terminals therein;

a second connector having a plurality of terminal accommodating chambers for receiving second terminals therein, said second connector being adapted to be mated with said first connector upon relative movement of said second connector in a rearward direction with respect to said first connector, said rearward direction being parallel to said longitudinal direction, said second connector including a retaining projection;

retaining means connected to said first connector for retaining said first connector to said second connector in a completely locked position, said retaining means including a lock member which is slidably secured to said first connector so as to be moveable in said longitudinal direction and which is pivotable with respect to said first connector; and biasing means for urging said lock member toward said second connector in a forward direction, opposite said rearward direction, wherein said lock member is engageable with said retaining projection when said first and second connectors are in said completely locked position.

2. The partial-fitting prevention connector of claim 1, wherein said lock member includes a retaining member at a forward end thereof for engaging said retaining projection.

3. The partial-fitting prevention connector of claim 2, wherein when said first and second connector are initially mated with each other, said retaining member abuts against a rearward face of said retaining projection causing said lock member to be moved in said rearward direction against said biasing means.

4. The partial-fitting prevention connector of claim 3, further comprising cam means for causing said lock member to automatically pivot upon movement of said lock member a predetermined distance in said rearward direction so that said retaining member disengages said rearward face of said retaining projection.

5. The partial-fitting prevention connector of claim 4, wherein said cam means includes a first lock releasing member provided on said lock member and a second lock releasing member provided on said housing, each of said lock releasing members have inclined mating cam surfaces.

6. The partial-fitting prevention connector of claim 4, wherein upon said pivotable movement of said lock member, said lock member is urged in said forward direction to thereby cause said retaining member to automatically engage a front face of said retaining projection.

7. The partial-fitting prevention connector of claim 1, further comprising a waterproof packing against which one end of an insertion frame of said second connector is pressed when said first and second connectors are mated together, thereby preventing the intrusion of water.

8. The partial-fitting prevention connector of claim 7, further comprising a rubber plug circumscribing wires secured to said first connectors for preventing the intrusion of water along said wires into said first connector.

9. A partial-fitting prevention connector of claim 1, wherein said first housing includes an opening in a side wall thereof to allow a user to rotate said lock member to disengage said retaining member from said retaining rojection.

10. The partial-fitting prevention connector of claim 9, further comprising a cover attached to said first connector for covering said opening.

11. The partial-fitting prevention connector of claim 10, wherein said cover is pivotally attached to said first connector.

12. The partial-fitting prevention connector of claim 1, wherein said biasing means includes a spring retaining portion secured to said first connector and a spring secured at one end to said spring retaining portion and at an opposite end to said lock member.

* * * * *